US007046206B2

(12) United States Patent
Minoura et al.

(10) Patent No.: US 7,046,206 B2
(45) Date of Patent: May 16, 2006

(54) STRUCTURE FOR MOUNTING ANTENNA

(75) Inventors: Yasuhiro Minoura, Gunma (JP); Yoshito Noguchi, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 11/001,621

(22) Filed: Dec. 2, 2004

(65) Prior Publication Data

US 2005/0122275 A1 Jun. 9, 2005

(30) Foreign Application Priority Data

Dec. 3, 2003 (JP) ..... P2003-404013

(51) Int. Cl.
*H01Q 1/24* (2006.01)

(52) U.S. Cl. ..... 343/702; 343/906

(58) Field of Classification Search ..... 343/702, 343/900, 901, 902, 903, 715, 895, 725, 727, 343/729, 906, 888; H01Q 1/24
See application file for complete search history.

(56) References Cited

U.S. PATENT DOCUMENTS 6,107,966 A * 8/2000 Fahlberg ..... 343/702
6,201,503 B1 * 3/2001 Oshiyama ..... 343/702
6,215,446 B1 4/2001 Sullivan et al.
6,218,993 B1 * 4/2001 Chao et al. ..... 343/702
2002/0101380 A1 8/2002 Pruss et al.

FOREIGN PATENT DOCUMENTS

DE 298 11 273 U1 10/1998
JP 2002-141719 5/2002

* cited by examiner

*Primary Examiner*—Hoanganh Le
(74) *Attorney, Agent, or Firm*—Morgan, Lewis & Bockius LLP

(57) ABSTRACT

A casing body is formed with a hole having an inner wall formed with a recess. A holder is made of resin and has an elastic retainer which is retractably projected from an outer peripheral face of the holder and engaged with the recess when the holder is fitted into the hole. A rod-shaped antenna element is held in the holder so as to movable between a first position being accommodated in the casing body and a second position being withdrawn from the casing body. The antenna element has a first power feeding portion and a second power feeding portion, the antenna element. A conductive contact member is disposed in the holder. A first portion of the contact member is brought into contact with the first power feeding portion when the antenna element is placed in the first position and with the second power feeding portion when the antenna element is placed in the second position. A second portion of the contact member is extended to the outside of the holder. A power feeding terminal is disposed in the casing body so as to come in contact with the second portion of the contact member.

7 Claims, 10 Drawing Sheets

STRUCTURE FOR MOUNTING ANTENNA

BACKGROUND OF THE INVENTION

The present invention relates to a structure which enables a rod-shaped antenna element to be mounted on a casing body of a portable phone or the like. The antenna element is movable between a position accommodated within the casing body and a position withdrawn from the casing body.

FIGS. 13A and 13B show a conventional structure for mounting a rod-shaped antenna. FIG. 13A shows the accommodated position, and FIG. 13B shows the withdrawal position.

In this example, a casing body 10 is provided with a receiving holder 12 which is fixed thereto. A holder 14 made of conductive material is fixed to this receiving holder 12, having a male thread 14*a* formed in the holder 14 screwed into a female thread 12*a* formed in the receiving holder 12. A rod-shaped antenna element 16 is arranged in this holder 14 so as to be movable in an axial direction thereof.

The rod-shaped antenna element 16 includes power supply parts 16*a*, 16*b* made of conductive material, at positions respectively opposed to the holder 14 in either of the accommodated position and the withdrawal position. The holder 14 is provided with a power supply spring 18 made of conductive material so as to be brought into elastic contact with the power supply parts 16*a*, 16*b*, so that electrical connection is established between the power supply parts 16*a*, 16*b* and the holder 14 by way of this power supply spring 18. Further, a power supply terminal 20 which is provided in the casing body 10 is brought into elastic contact with the holder 14, so that the power supply parts 16*a*, 16*b* of the rod-shaped antenna element 16 are electrically connected appropriately to an electrical circuit which is contained in the casing body 10. A top loading 22 is further provided on the rod-shaped antenna element 16.

The holder 14 is relatively heavy, because it is made of conductive metal. Moreover, the receiving holder 12 is also heavy, because it is generally made of metal, in order to form the female thread 12*a*. Under the circumstance, as the antenna mounting structure for the portable phone or the like which is desired to be light-weight.

SUMMARY OF THE INVENTION

It is therefore an object of the invention to provide an antenna mounting structure having light weight.

In order to achieve the above object, according to the invention, there is provided an antenna mounting structure, comprising:

a casing body, formed with a hole having an inner wall formed with a recess at a first circumferential position;

a holder, made of resin and having an elastic retainer which is retractably projected from an outer peripheral face of the holder and engaged with the recess when the holder is fitted into the hole;

a rod-shaped antenna element, held in the holder so as to movable between a first position being accommodated in the casing body and a second position being withdrawn from the casing body, the antenna element having a first power feeding portion and a second power feeding portion, the antenna element;

a conductive contact member, disposed in the holder and comprises:

a first portion which is brought into contact with the first power feeding portion when the antenna element is placed in the first position and with the second power feeding portion when the antenna element is placed in the second position; and a second portion extended to the outside of the holder; and a power feeding terminal, disposed in the casing body so as to come in contact with the second portion of the contact member.

Preferably, the retainer is a cantilevered piece.

With the above configuration, the holder made of resin is fitted into the hole formed in the casing body and prevented from being detached therefrom by the retainer engaged with the recess formed in the inner wall of the hole. The light weight structure can be attained in comparison with the case where the holder is made of metal and the holder is further received by the receiving holder.

Preferably, the holder includes a first section having an aperture from which the contact member is inserted, and a second section which closes the aperture.

Here, it is preferable that the second portion of the contact member extends through a boundary between the first section and the second section of the holder.

In this case, the assembling work of the holder incorporating the contact member can be facilitated.

Preferably, an aperture edge of the hole is formed with a notch at the second circumferential position of the hole so as to allow the retainer to pass through when the holder is fitted into the hole.

In this case, the insertion work of the holder can be facilitated. Further, the position of the retainer to be placed can be reliably recognized.

Preferably, at least one of an outer face of the retainer and a bottom face of the recess is formed with a slanted face which causes the retainer to be retracted inward when the holder is rotated within the hole in a circumferential direction of the hole.

In this case, it is possible to easily obtain a condition that the holder can be detached from the hole by the simple operation of rotating the holder.

Here, it is preferable that: a projection is formed on the outer peripheral face of the holder; a first groove is formed on the inner wall of the hole at a second circumferential position so as to allow the projection to pass through when the holder is fitted into the hole; a second groove is formed on the inner wall of the hole at a third circumferential position at which the projection is placed when the holder is rotated to a position that the retainer is retracted; and a third groove is formed so as to connect the first groove and the second groove so as to allow the projection to pass through when the holder is rotated.

In this case, the prevention of the detachment of the holder from the hole during the above rotating operation can be attained. Further, the circumferential position that the holder can be detached is reliable recognized.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below in detail with reference to the accompanying drawings.

Figure 1A:
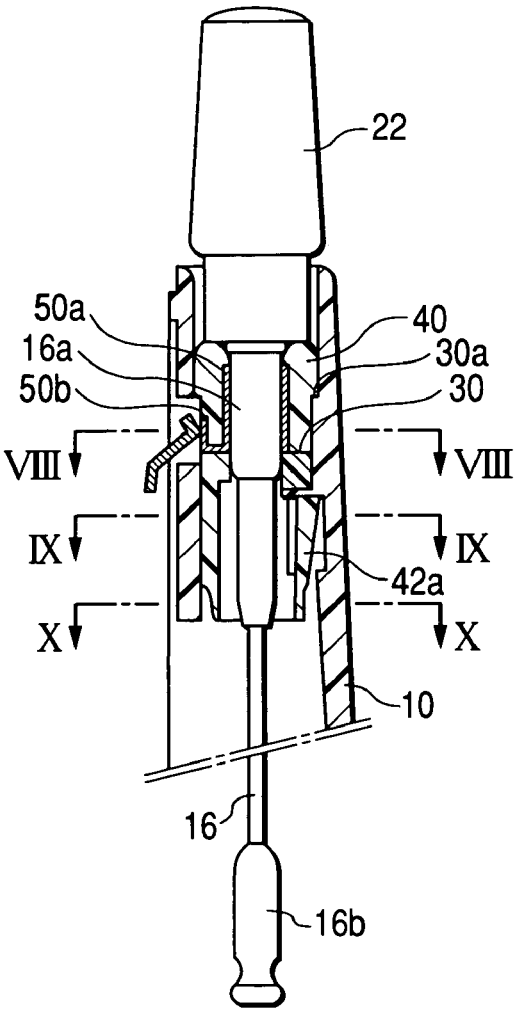
FIG. 1A is a section view of an essential part of an antenna mounting structure according to one embodiment of the invention, showing a state that an antenna element is at an accommodated position.
Figure 1B:
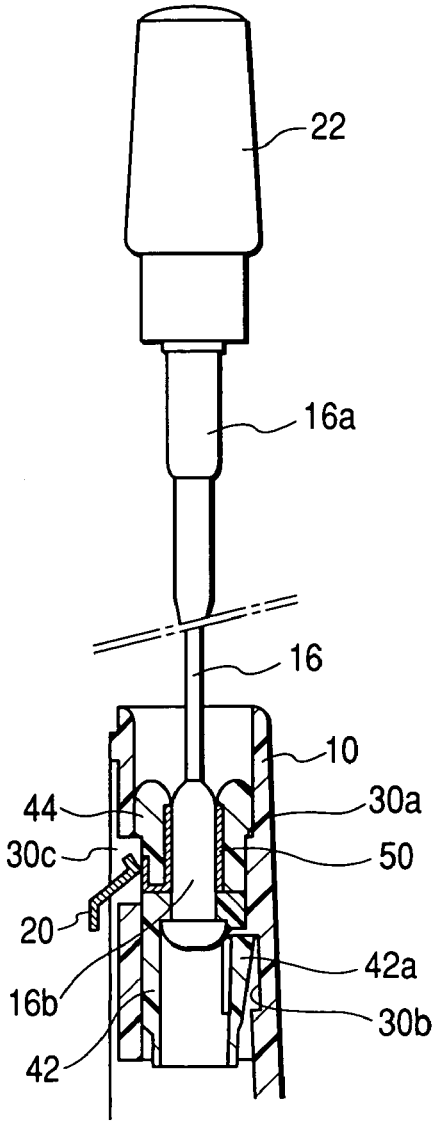
FIG. 1B is a section view of the essential part of the antenna mounting structure of FIG. 1A, showing a state that the antenna element is at a withdrawal position.
Figure 2A:
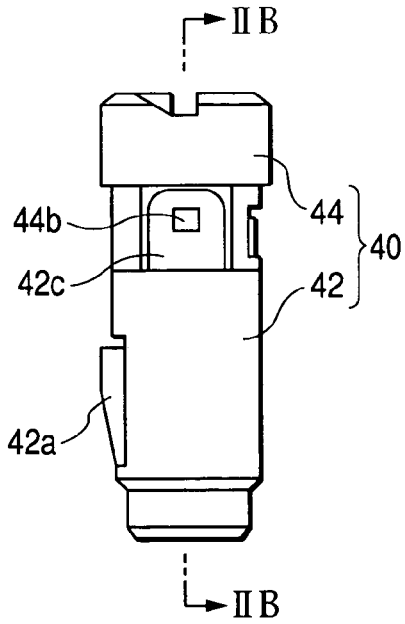
FIG. 2A is a right side view of a holder in the antenna mounting structure.
Figure 2B:
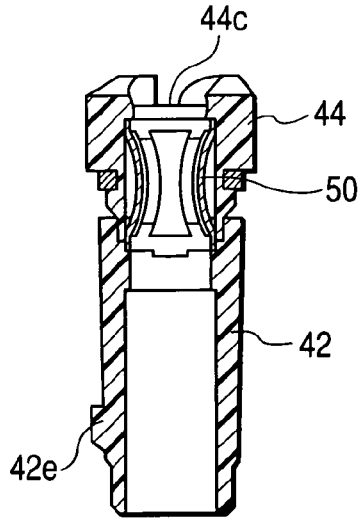
FIG. 2B is a section view taken along a line IIB—IIB in FIG. 2A.
Figure 2C:
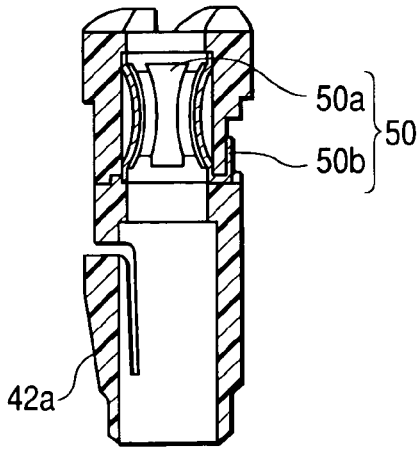
FIG. 2C is a section view taken along a line IIC—IIC in FIG. 2D.
Figure 2D:
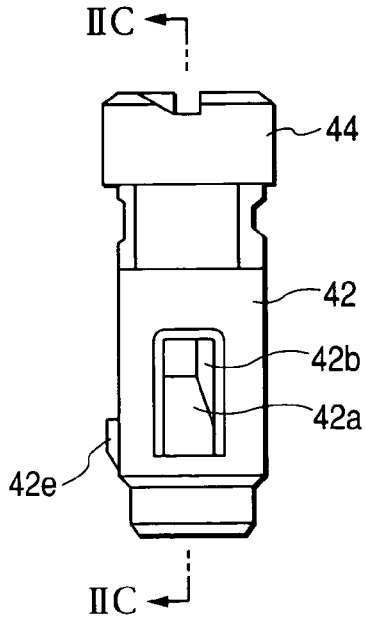
FIG. 2D is a front view of the holder.
Figure 3A:
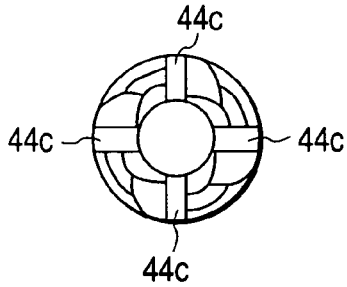
FIG. 3A is a top view of an upper section of the holder.
Figure 3C:
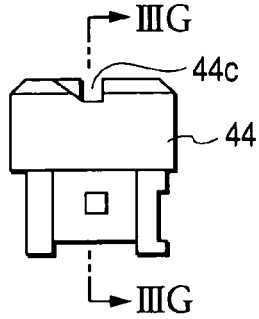
FIG. 3C is a right side view of the upper section of the holder.
Figure 3B:
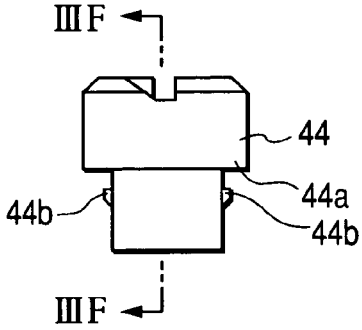
FIG. 3B is a front view of the upper section of the holder.
Figure 3D:
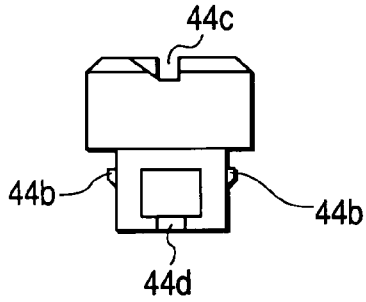
FIG. 3D is a back view of the upper section of the holder.
Figure 3E:
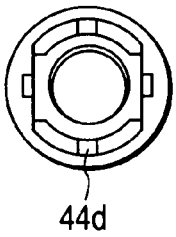
FIG. 3E is a bottom view of the upper section of the holder.
Figure 3G:
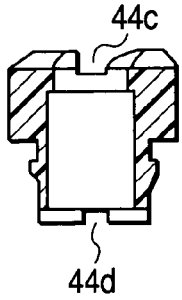
FIG. 3G is a section view taken along a line IIIG—IIIG in FIG. 3C.
Figure 3F:
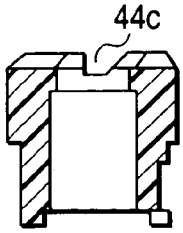
FIG. 3F is a section view taken along a line IIIF—IIIF in FIG. 3B.
Figure 4A:
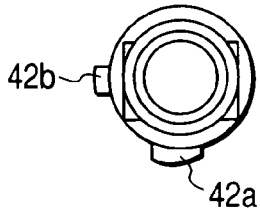
FIG. 4A is a bottom view of a lower section of the holder.
Figure 4B:
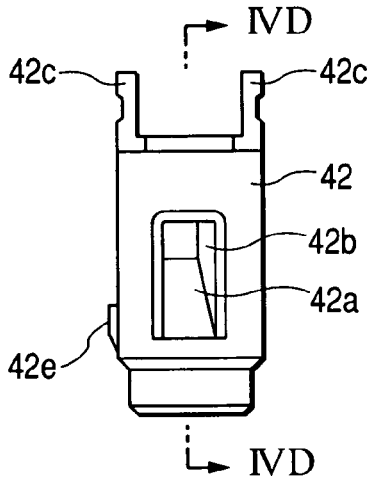
FIG. 4B is a front view of the lower section of the holder.
Figure 4C:
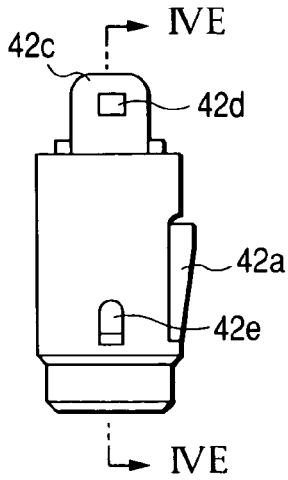
FIG. 4C is a left side view of the lower section of the holder.
Figure 4D:
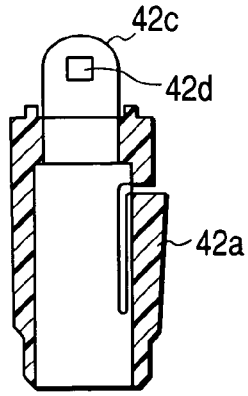
FIG. 4D is a section view taken along a line IVD—IVD in FIG. 4B.
Figure 4E:
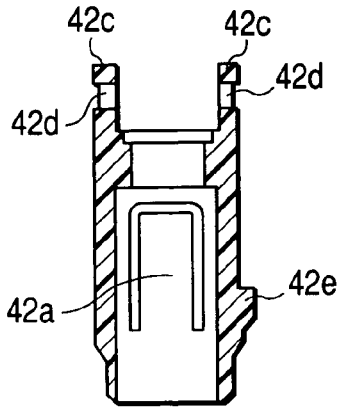
FIG. 4E is a section view taken along a line IVE—IVE in FIG. 4C.

As shown FIG. 1, a casing body 10 of a portable phone or the like is provided with a mounting hole 30 which has a stepped part 30*a* so that a diameter of the mounting hole 30 may be enlarged at a side of an open end. This mounting hole 30 is provided, on its inner peripheral wall, with an engaging recess 30*b* adapted to be opposed to a tongue piece 42*a* of a holder 40 (will be described below), and an opening 30*c* adapted to be opposed to a tongue piece 50*b* of a power supply spring 50 (will be described below).

The holder 40 is formed of resin, and divided in two along a dividing plane substantially perpendicular to an inserting direction, thereby to be composed of an upper section 44 and a lower section 42.

As shown in FIG. 4, the lower section 42 is provided, in its peripheral part, with the tongue piece 42*a* which is projected outwardly making an opposite side to the inserting direction as a free end, and which can be elastically deformed inwardly in a radial direction. The tongue piece 42*a* is provided with a slanted face from its base end at a lower side to the free end, so that the tongue piece 42*a* can be elastically deformed smoothly, inwardly in the radial direction, when the holder 40 is inserted into the mounting hole 30. The tongue piece 42*a* is further provided with another slanted face 42*b* in a chamfered shape, on its one side in a circumferential direction.

The lower section 42 is further provided, at its upper end, with a pair of engaging arms 42*c* projected in a direction opposite to the inserting direction, and engaging windows 42*d* are formed in respective distal end areas of the engaging arms 42*c*. A pair of these engaging arms 42*c* serves to interconnect the lower section 42 and the upper section 44. Moreover, a stopper 42*e* in a shape of a protrusion is provided on the peripheral part of the lower section 42 at the lower end area in the inserting direction.

As shown in FIG. 3, the upper section 44 is provided with a stepped part 44*a* so that a diameter of the upper section 44 may be enlarged at an opposite side to the inserting direction. The stepped part 44*a* is brought into contact with the stepped part 30*a* of the mounting hole 30 thereby to restrict the insertion at a predetermined position. A peripheral part of the upper section 44 in front of the stepped part 44*a* in the inserting direction is clamped between a pair of the engaging arms 42*c* of the lower section 42.

The upper section 44 is further provided, on its face to be clamped, with engaging projections 44*b* which are adapted to be inserted into and engaged with the engaging windows 42*d* of the engaging arms 42*c*. These engaging projections 44*b* also serve to interconnect the lower section 42 and the upper section 44. When the upper section 44 is assembled to the lower section 42, a pair of the engaging arms 42*c* are elastically deformed permitting the engaging projections 44*b* to be engaged with the engaging windows 42*d*.

The engaging windows 42*d* and the engaging projections 44*b* are formed in such a manner that they may not be easily detached in this engaged state, against a force in a direction of separating them. The upper section 44 is provided, on its upper end face, with grooves 44*c* for rotary operation which enable the upper section 44 to rotate in only one direction around the axis in the inserting direction. Further, there is formed a gap 44*d* through which the tongue piece 50*b* of the power supply spring 50, which will be described below, is rendered to pass to be withdrawn.

Figure 5A:
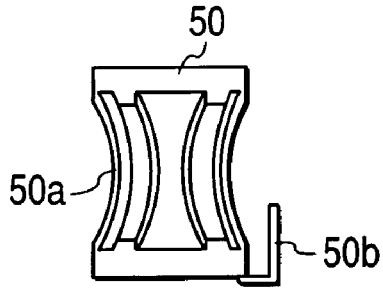
FIG. 5A is a front view of a power supply spring in the antenna mounting structure.
Figure 5B:
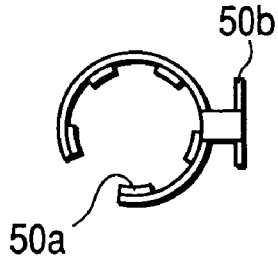
FIG. 5B is a top view of the power supply spring.
Figure 5C:
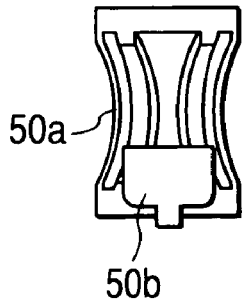
FIG. 5C is a right side view of the power supply spring.

The power supply spring 50 is made of a sheet metal having elasticity such as beryllium copper, phosphor bronze and so on, and arranged on an inner peripheral face of the upper section 44. As shown in FIG. 5, the power supply spring 50 is in a shape of a so-called barrel spring, including an elastic contact portion 50*a* adapted to come into contact with the power supply parts 16*a*, 16*b* of the rod-shaped antenna element 16, and the tongue piece 50*b* to be extended to an outer peripheral side of the upper section 44. A part interconnecting the elastic contact portion 50*a* and the tongue piece 50*b* is adapted to pass the gap 44*d* which is formed on the dividing plane between the lower section 42 and the upper section 44.

Figure 6:
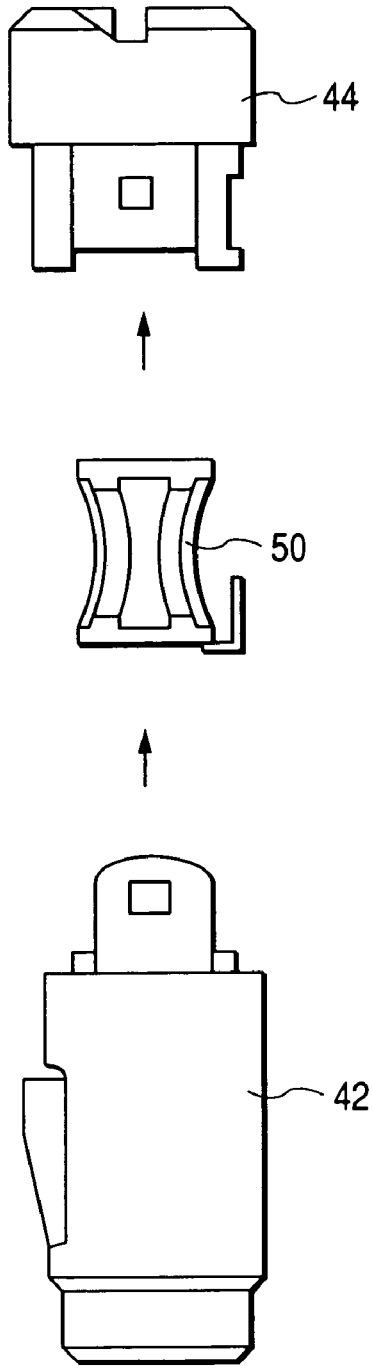
FIG. 6 is a view for explaining how to assemble the upper section of the antenna mounting structure, the power supply spring, and the lower section of the antenna mounting structure.
Figure 9:
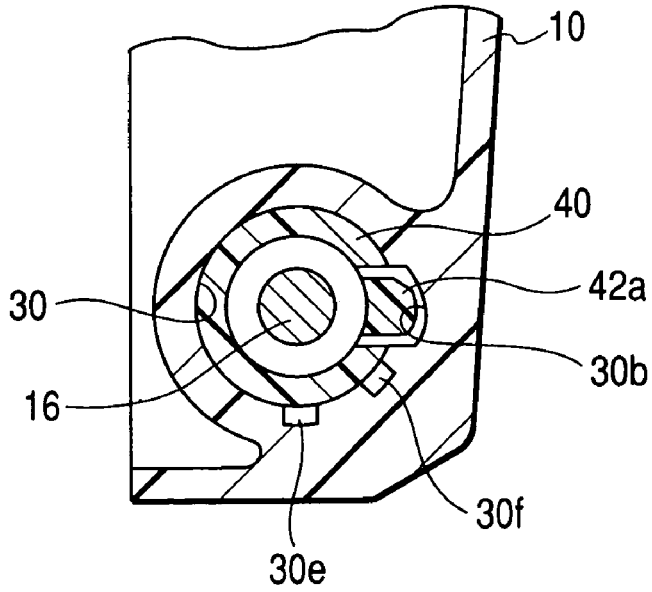
FIG. 9 is a section view taken along a line IX—IX in FIG. 1A.

As shown in FIG. 6, the elastic contact portion 50*a* of the power supply spring 50 is incorporated into the upper section 44, and then, the lower section 42 is assembled to the upper section 44, while a pair of the engaging windows 42*d* of the engaging arms 42*c* are engaged with the engaging projections 44*b*. In this manner, the lower section 42 and the upper section 44 are joined to become integral with each other to form the holder 40, as shown in FIG. 2. When the holder 40 thus integrated is inserted into the mounting hole 30 in a predetermined posture with respect to the casing body 10, the tongue piece 42*a* is elastically deformed inwardly in the radial direction to permit the insertion. After the tongue piece 42*a* has been inserted up to a position opposed to the engaging recess 30*b* of the mounting hole 30, the tongue piece 42*a* is elastically recovered and engaged with the engaging recess 30*b*, as shown in FIG. 9, and movement of the backward end part 42 in the withdrawing direction will be restricted.

Figure 8:
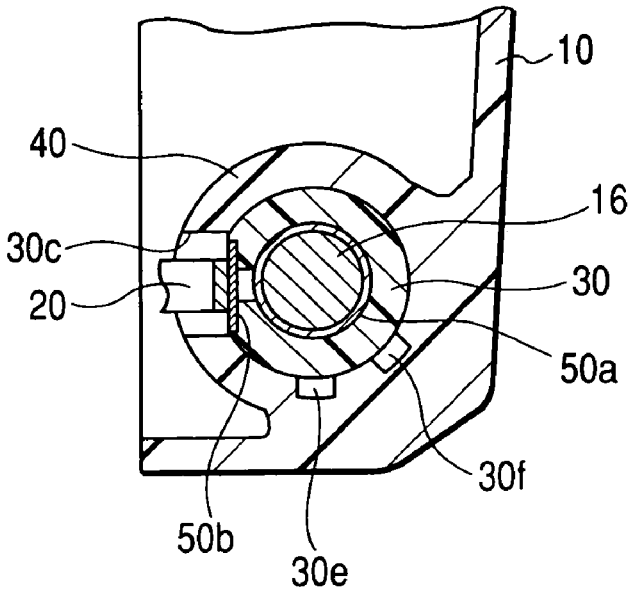
FIG. 8 is a section view taken along a line VIII—VIII in FIG. 1A.

At the same time, the stepped part 44*a* of the upper section 44 comes into contact with the stepped part 30*a* of the mounting hole 30, and movement of the upper section 44 in the inserting direction will be restricted. In this manner, the holder 40 is fixed to the casing body 10. The rod-shaped antenna element 16 is arranged inside the holder 40 so as to be movable in the axial direction. In the withdrawal position, the power supply part 16*b* is brought into elastic contact with the elastic contact portion 50*a* of the power supply spring 50 to be electrically connected thereto. In the accommodated position, the power supply part 16*a* is brought into elastic contact with the elastic contact portion 50*a* to be electrically connected thereto. In this state, the tongue piece 50*b* of the power supply spring 50 is in a state opposed to the opening 30*e* which is formed in the mounting hole 30, as shown in FIG. 8, and the power supply terminal 20 which is provided inside the casing body 10 and made of a leaf spring or the like is brought into elastic contact with the tongue piece 50*b* to be electrically connected thereto. As a result, the power supply parts 16*a*, 16*b* of the rod-shaped antenna element 16 are electrically connected appropriately to the electric circuit which is provided inside the casing body 10, by way of the power supply spring 50 and the power supply terminal 20 in contact therewith.

By the way, in order that the tongue piece 42*a* may be engaged with the engaging recess 30*b* of the mounting hole 30, after the holder 40 has been inserted into the mounting hole 30, the holder 40 must take the predetermined posture with respect to the mounting hole 30 around the axis in the inserting direction. In other words, the tongue piece 42*a* must be aligned with the engaging recess 30*b* in the axial direction.

Figure 7:
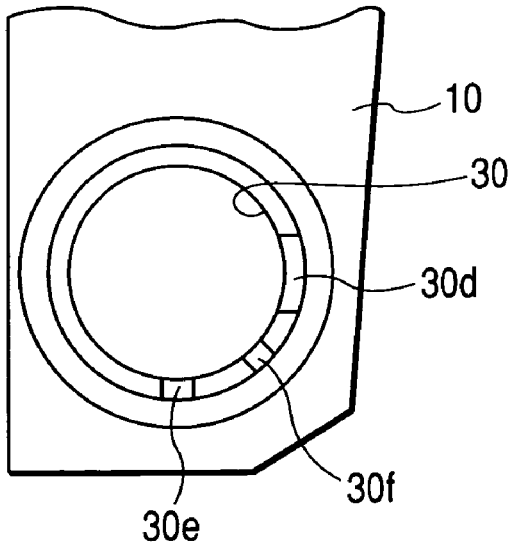
FIG. 7 is a plan view of a mounting hole in the antenna mounting structure.

In this embodiment, as shown in FIG. 7, a chamfered portion 30*d* which has a slightly larger width than a width of the tongue piece 42*a* for enabling the tongue piece 42*a* to just pass through is provided on an edge of the mounting hole 30 which the tongue piece 42*a* comes into contact with, when the holder 40 is inserted into the mounting hole 30 in the predetermined posture around the axis, at the same axial position as the engaging recess 30*b*.

Figure 10:
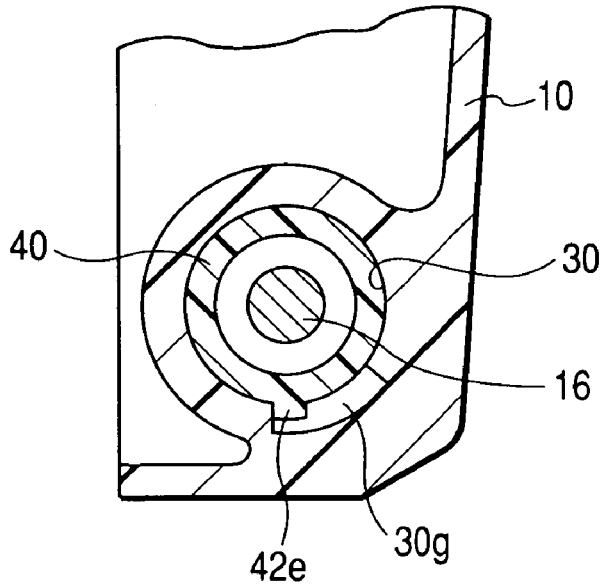
FIG. 10 is a section view taken along a line X—X in FIG. 1A.

Moreover, a first vertical groove 30*e* which the stopper 42*e* can pass through when the holder 40 is inserted in the predetermined posture is formed in an axial direction on the inner peripheral wall of the mounting hole 30. Further, a second vertical groove 30*f* which the stopper 42*e* can pass through, when the holder 40 is rotated for withdrawal inside the mounting hole 30 by 45 degree, for example, is formed in the axial direction on the inner peripheral wall of the mounting hole 30. Still further, a circumferential groove 30*g* which the stopper 42*e* can pass through from the first vertical groove 30*e* to the second vertical groove 30*f*, when the holder 40 is rotated around the axis from the inserting position where the tongue piece 42*a* is engaged with the engaging recess 30*b* is formed on the inner peripheral wall of the mounting hole 30, as shown in FIG. 10.

Figure 11:
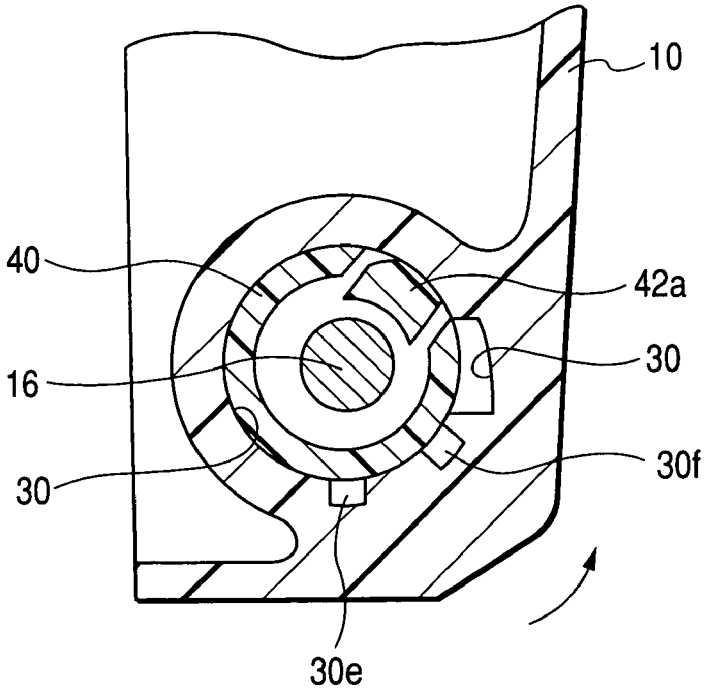
FIG. 11 is a section view taken along the line IX—IX in FIG. 1A, showing a state when the holder is to be detached.
Figure 12:
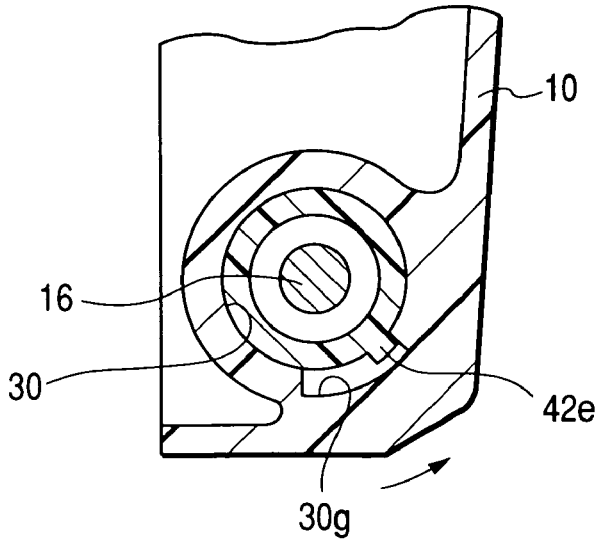
FIG. 12 is a section view taken along a line X—X in FIG. 1A, showing the state of FIG. 11.
Figure 13A:
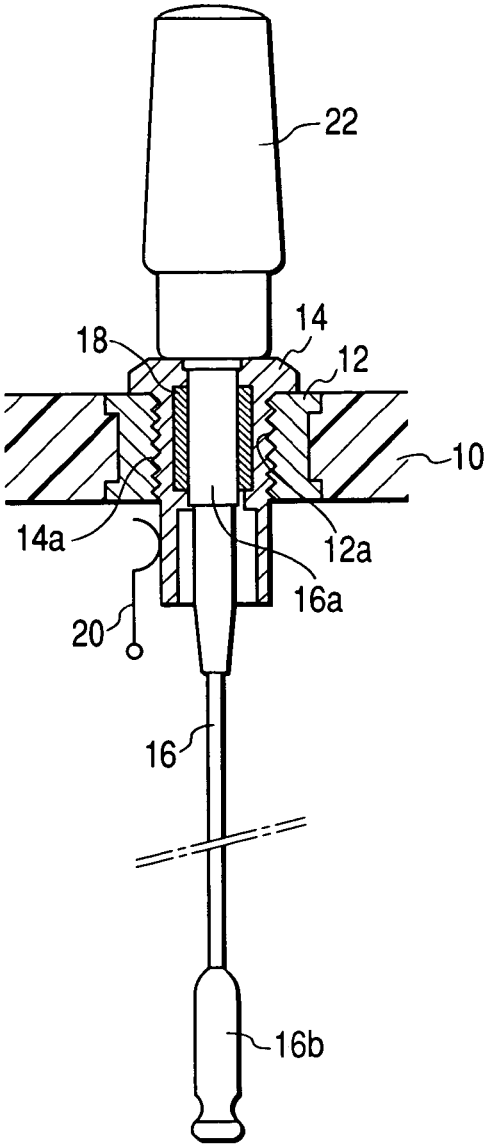
FIG. 13A is a section view of an essential part of a conventional antenna mounting structure, showing a state that an antenna element is at an accommodated position.
Figure 13B:
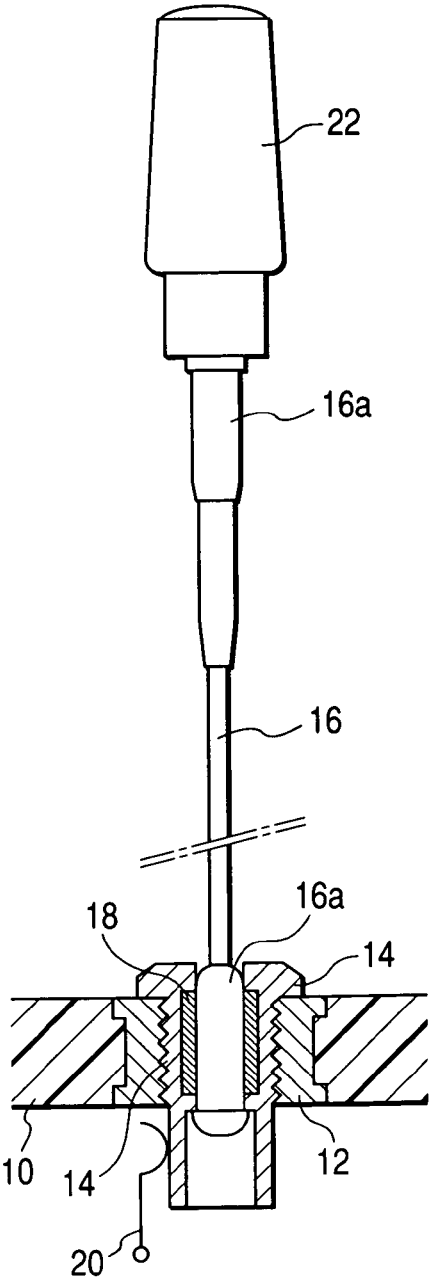
FIG. 13B is a section view of the essential part of the antenna mounting structure of FIG. 13A, showing a state that the antenna element is at a withdrawal position.

In this structure, when the holder 40 has been rotated inside the mounting hole 30 around the axis, by fitting an adequate tool into the grooves 44*c* for rotary operation of the holder 40, the slanted face 42*b* of the tongue piece 42*a* comes contact with the circumferential edge of the engaging recess 30*b*. Then, a component of a force is applied inwardly in the axial direction, and the tongue piece 42*a* is elastically deformed inwardly in the radial direction as shown in FIG. 11, to be disengaged from the engaging recess 30*b*. At the same time, the stopper 42*e* passes through the circumferential groove 30*g*, as shown in FIG. 12.

When the holder 40 is rotated by a predetermined degree, the stopper 42*e* comes into alignment with the second vertical groove 30*f* thereby to restrict the rotation. It is apparent that in the state where the rotation is restricted, the tongue piece 42*a* is completely disengaged from the engaging recess 30*b*. Consequently, the holder 40 can be withdrawn from the mounting hole 30 by making the stopper 42*e* pass through the second vertical groove 30*f*, and exchange or so of the rod-shaped antenna element 16 can be easily conducted.

In this embodiment, the holder 40 is divided in two along the dividing plane which is substantially perpendicular to the inserting direction, into the lower section 42 and the upper section 44. However, the invention is not limited to this embodiment, but the holder 40 may be vertically divided in two along a dividing plane which is parallel to the inserting direction, so that the power supply spring 50 can be easily assembled to the holder 40.

Moreover, the mechanism for making the two divided parts integral into the holder 40 may have any structure. Further, the two divided parts may be appropriately joined by adhesion or welding instead of employing the mechanism. Alternatively, without dividing the holder in two, the holder may be integrally molded with the power supply spring 50.

Still further, the tongue piece 42*a* is not limited to the one in the above described embodiment in which the movement in the withdrawing direction is restricted by an end face of the free end of the tongue piece 42*a*. The tongue piece 42*a* may be in any shape, provided that it can be elastically deformed to allow the insertion of the holder 40 into the mounting hole 30, and elastically recovered after the holder 40 has been inserted up to the determined position, thereby to restrict the movement in the withdrawing direction. For example, the tongue piece may be extended downward in the inserting direction, and may be provided with a hook-shaped projection on an outer periphery of the free end, so that the movement in the withdrawing direction can be restricted by engaging this hook-shaped projection.

Still further, the structure for disengaging the tongue piece 42*a* from the engaging recess 30*b* by rotating the holder 40 around the axis is not limited to the above described embodiment in which the tongue piece 42*a* is provided with the slanted face 42*b*. The tongue piece 42*a* may be provided with a curved face instead of the slanted face 42*b*. A face of the engaging recess 30*b* which the tongue piece 42*a* comes in contact with may be a slanted face or a curved face so as to exert a component of a force on the tongue piece 42*a* inwardly in the radial direction. It is apparent that both the tongue piece 42*a* and the contact face of the engaging recess 30*b* may be provided with the slanted face or the curved face.

Furthermore, if the posture of the holder around the axis when it is withdrawn from the mounting hole 30 is not limited, the slanted face or the curved face may be provided not only on the contact face between the tongue piece 42 and the engaging recess 30*b* at one side in the circumferential direction, but also on the contact faces at both sides in the circumferential direction.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An antenna mounting structure, comprising:

a casing body, formed with a hole having an inner wall formed with a recess at a first circumferential position;

a holder, made of resin and having an elastic retainer which is retractably projected from an outer peripheral face of the holder and engaged with the recess when the holder is fitted into the hole;

a rod-shaped antenna element, held in the holder so as to be movable between a first position being accommodated in the casing body and a second position being withdrawn from the casing body, the antenna element having a first power feeding portion and a second power feeding portion;

a conductive contact member, disposed in the holder and comprises:

a first portion which is brought into contact with the first power feeding portion when the antenna element is placed in the first position and with the second power feeding portion when the antenna element is placed in the second position; and a second portion extended to the outside of the holder; and a power feeding terminal, disposed in the casing body so as to come in contact with the second portion of the contact; wherein the holder includes a first section having an aperture from which the contact member is inserted, and a second section which retains the contact member within the aperture; and the first section and the second section are separable.

2. The antenna mounting structure as set forth in claim 1, wherein the retainer is a cantilevered piece.

3. The antenna mounting structure as set forth in claim 1, wherein the second portion of the contact member extends through a boundary between the first section and the second section of the holder.

4. The antenna mounting structure as set forth in claim 1, wherein an aperture edge of the hole is formed with a notch at the second circumferential position of the hole so as to allow the retainer to pass through when the holder is fitted into the hole.

5. The antenna mounting structure as set forth in claim 1, wherein at least one of an outer face of the retainer and a bottom face of the recess is formed with a slanted face which causes the retainer to be retracted inward when the holder is rotated within the hole in a circumferential direction of the hole.

6. The antenna mounting structure as set forth in claim 5, wherein:

a projection is formed on the outer peripheral face of the holder;

a first groove is formed on the inner wall of the hole at a second circumferential position so as to allow the projection to pass through when the holder is fitted into the hole;

a second groove is formed on the inner wall of the hole at a third circumferential position at which the projection is placed when the holder is rotated to a position that the retainer is retracted; and a third groove is formed so as to connect the first groove and the second groove so as to allow the projection to pass through when the holder is rotated.

7. An antenna mounting structure, comprising:

a casing body, formed with a hole having an inner wall formed with a recess;

a holder, made of resin and having an elastic retainer which is retractably projected from an outer peripheral face of the holder and engaged with the recess when the holder is fitted into the hole;

an antenna element, held in the holder; and a conductive contact member, disposed in the holder, wherein the holder includes a first section having an aperture from which the contact member is inserted, and a second section which retains the contact member within the aperture; and the first section and the second section are separable.

* * * * *